United States Patent [19]

Tabaru

[11] Patent Number: 5,049,053

[45] Date of Patent: Sep. 17, 1991

[54] METAL MOLD FOR MOLDING ANISOTROPIC PERMANENT MAGNETS

[75] Inventor: Kazunori Tabaru, Saitama, Japan

[73] Assignee: Hitachi Metals, Ltd., Tokyo, Japan

[21] Appl. No.: 394,573

[22] Filed: Aug. 16, 1989

[30] Foreign Application Priority Data

Aug. 18, 1988 [JP] Japan ..... 63-205214
Feb. 17, 1989 [JP] Japan ..... 1-38093

[51] Int. Cl.[5] ..... B30B 11/04

[52] U.S. Cl. ..... 425/3; 249/134; 249/158; 264/DIG. 58; 425/78; 425/352; 425/DIG. 33

[58] Field of Search ..... 425/3, 77, 78, 174, 425/174.8 R, 195, 352, 254, 355, DIG. 33; 264/22, 24, 109, DIG. 58; 249/134, 135, 158

[56] References Cited

U.S. PATENT DOCUMENTS

| | | | |
|---|---|---|---|
| 3,555,621 | 1/1971 | Hara | 425/3 |
| 3,564,654 | 2/1971 | Steingroever | 425/3 |
| 3,694,115 | 9/1972 | Steingroever | 425/3 |
| 4,197,067 | 4/1980 | Dore | 425/3 |
| 4,604,042 | 8/1986 | Tanigawa et al. | 425/3 |
| 4,666,389 | 5/1987 | Relis et al. | 425/78 |

FOREIGN PATENT DOCUMENTS

| | | | |
|---|---|---|---|
| 1199674 | 8/1965 | Fed. Rep. of Germany | 249/112 |
| 60-115422 | 6/1985 | Japan | 264/DIG. 58 |
| 62-14410 | 1/1987 | Japan | 264/DIG. 58 |

*Primary Examiner*—James C. Housel
*Attorney, Agent, or Firm*—McGlew & Tuttle

[57] ABSTRACT

Anisotropic rare-earth permanent magnets characterized in that an aggregate of a plurality of blocks, to each of which anisotropy is imparted, is formed using powders of magnetic material containing rare-earth elements, and the adjoining blocks are powder-metallurgically bonded together under pressure into one piece; a method of making anisotropic rare-earth permanent magnets by molding anisotropic blocks by magnetic-field molding, arranging, aggregating and sealing a plurality of blocks in a bag, and cold hydrostatic pressing the aggregate of blocks in the absence of magnetic field; and a suitable metal mold for magnetic-field molding anisotropic permanent magnets of a relatively large size.

3 Claims, 6 Drawing Sheets

METAL MOLD FOR MOLDING ANISOTROPIC PERMANENT MAGNETS

BACKGROUND OF THE INVENTION

This invention relates to anisotropic rare-earth permanent magnets of the Sm-Co system or Nd-Fe-B system, for example, a method of making the same, and a metal mold for molding anisotropic permanent magnets; and more particularly to anisotropic rare-earth permanent magnets, including those of a large size as used in wigglers and having anisotropy or those having locally different anisotropy, a method of making the same, and a suitable metal mold for molding anisotropic permanent magnets of a particularly large size and having a cross section of a large slenderness ratio.

DESCRIPTION OF THE PRIOR ART

Anisotropic rare-earth permanent magnets, whose magnetic properties have been increasingly improved year after year as the study of physical properties has made steady progress since the development of Sm-Co magnets, have contributed, together with those recently developed Nd-Fe-B magnets, not only to the ongoing trend toward smaller and higher-performance equipment and devices to which they are applied, but also to the exploitation of new application fields. These anisotropic rare-earth permanent magnets are usually manufactured by powder metallurgical means. Taking a rare-earth cobalt magnet of a $Sm\text{-}CO_5$ type as an example, an alloy comprising 38 wt. % of Sm and the balance of Co is induction melted in an argon atmosphere, and the ingots produced by casting are pulverized in a ball mill, etc. in a protective atmosphere. The powder of several microns thus obtained is compression molded in a mold disposed in a magnetic field, and the molded product obtained is sintered at over 1,100° C. The sintered product is finally subjected to a heat treatment at 900° C. for less than about 1 hour to obtain an anisotropic permanent magnet having a high energy product.

A typical application of such an anisotropic rare-earth permanent magnet having high magnetic properties, as mentioned above, is a device called a wiggler. This comprises a device for producing synchrotron radiation from the corpuscular beam accelerated in an accelerator that is used as a free-electron laser, and imparts to an electron beam a lateral cyclic magnetic field. This device consists of a plurality of permanent magnet arrays disposed in such a manner that the magnet arrays face each other, with the electron beam interposed in between, and the N and S poles thereof alternately face the electron beam. In the above-mentioned magnet arrays, normally used are several scores of pairs of permanent magnets.

Although several scores of pairs of permanent magnets are used in the wiggler of the above-mentioned construction, the dimensions of individual permanent magnets constituting each pair tend to be relatively larger than those used in audio equipment, etc. Anisotropic rare-earth permanent magnets are invariably formed by powder metallurgical means, as noted earlier. Since magnetic flux per unit volume of a permanent magnet of this type is large due to the high magnetic properties inherent in these permanent magnets, efforts have been made to make permanent magnet of the smallest possible size when used for applications such as audio equipment and automobile parts. In order to impart anisotropy, a magnetic field is applied during molding so that powders of magnetic materials as the material are oriented in a predetermined direction. The means of applying a magnetic field is usually disposed on the outer periphery of molding means, including a metal mold. Given the effective working range of a magnetic field, the manufacturable sizes of molded products, that is, permanent magnets, are naturally limited. Consequently, it has heretofore been difficult to manufacture anisotropic rare-earth magnets of large sizes.

For this reason, anisotropic rare-earth permanent magnets, as used in the wiggler, whose weight ranges from 500 grams in a small block to more than 2 kilograms in a large block, are manufactured by aggregating a plurality of permanent magnet blocks and bonded together by adhesive. In a permanent magnet formed by bonding blocks, however, the adhesive existing between the permanent magnet blocks tends to form magnetic cavities, causing magnetic flux to be substantially reduced at the cavities. This deteriorates the consistency of the overall magnetic properties, leading to lowered performance of the device as a whole. Since the wiggler is used in an environment in which high vacuum and radiations including ultraviolet rays, etc. exist, an aggregated and adhesive-bonded permanent magnets poses various problems, such as evaporation of adhesive in high vacuum, deteriorated adhesion due to exposure to radiation. Furthermore, aggregating and joining work by means of adhesive is quite troublesome, involving much time and considerable manhours and some difficulty in maintaining consistent quality.

In general, the anisotropic permanent magnet is manufactured by placing a metal mold between lateral magnetic field generating members comprising a pair of permanent magnets or electromagnets, filling a molding cavity of the metal mold with raw material powders, and compression molding the powders by means of upper and lower punches slidably fitted to both ends of the molding cavity. This molding process usually employs a one-piece mold because of the large load exerted on the raw material powders in the cavity by the upper and lower punches.

FIG. 1 is a plan view of the essential part of a conventional metal mold used for molding a permanent magnet having a rectangular cross section. In the figure, a metal mold 1 is made of a magnetic material, such as tool steel, and has a molding cavity 2 machined thereon. Upper and lower punches (not shown) are slidably fitted to both ends of the molding cavity 2. Magnetic-field molding is performed by disposing permanent magnets or electromagnets (not shown) at the right and left of the metal mold 1 to generate a so-called lateral magnetic field orthogonally intersecting the molding direction.

In the conventional metal mold, since magnetic flux $\Phi$ is deflected at the edge of the molding cavity 2, parallel magnetic flux does not work on the molding cavity 2, resulting in lowered magnetic properties of the permanent magnets molded. This is attributable to the difference in permeability between the magnetic material comprising the metal mold 1 and the air in the molding cavity 2. The larger the absolute dimensions and the slenderness ratio of the cross-sectional area of the molding cavity 2, the lower become the magnetic properties of the permanent magnet molded. As the absolute dimensions and the slenderness ratio of the cross-sectional area of the molding cavity 2 become larger, the load exerted on the metal mold 1 also increases, causing a crack 2*a* at the corner of the molding cavity 2. This could lead to the reduced service life of the metal mold 1.

To solve the above-mentioned problems, a metal mold having the construction shown in FIG. 2 is employed. In FIG. 2, numeral 2 denotes a die, made of cemented carbide alloy, formed into a hollow square tube with a molding cavity 2 provided at the center thereof. 4*a* and 4*b* denote holders, disposed outside the die 3; the adjoining holders 4*a* and 4*b* being mitered and joined together by silver flux or adhesive. Although lateral magnetic field generating members (not shown) are disposed at the right and left of the metal mold 1, as in the case of FIG. 1, the holders 4*a* on the side facing the lateral magnetic field generating members are made of a magnetic material and the holders 4*b* orthogonally intersecting the above members are made of a nonmagnetic material.

With the above construction, the magnetic flux Φ forms a parallel magnetic field at any location in the molding cavity 2, leading to improved magnetic properties of the permanent magnet formed. However, the need for forming the joint parts of the holders 4*a* and 4*b* into miter joints requires a complex fabricating process, presenting a strength problem. That is, in a metal mold having a large cross-sectional area of the molding cavity 2, cracks could be caused at corners of the die 3, as noted above, reducing the life of the metal mold.

SUMMARY OF THE INVENTION

It is the first object of this invention to provide anisotropic rare-earth permanent magnets of a one-piece construction and large size that eliminate the use of dissimilar materials, such as adhesive.

It is the second object of this invention to provide a method of manufacturing the above-mentioned anisotropic rare-earth permanent magnets.

It is the third object of this invention to provide a suitable metal mold for molding anisotropic permanent magnets having large cross-sectional dimensions.

DETAILED DESCRIPTION OF THE EMBODIMENTS

Figure 1:
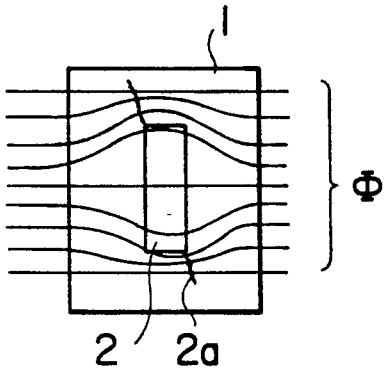
FIG. 1 (PRIOR ART)
FIGS. 1 and 2 are plan views of the essential parts of conventional metal molds.
Figure 2:
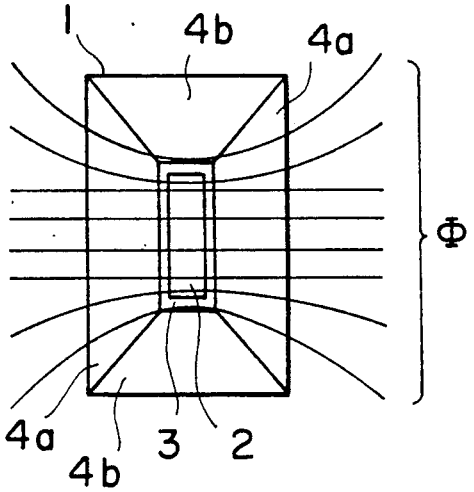
FIG. 2 (PRIOR ART)
Figure 3:
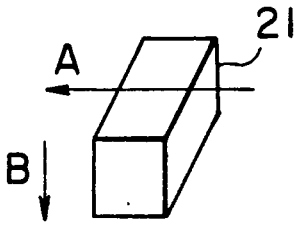
FIG. 3 and 4 are perspective views illustrating the first embodiment of this invention.
Figure 4:
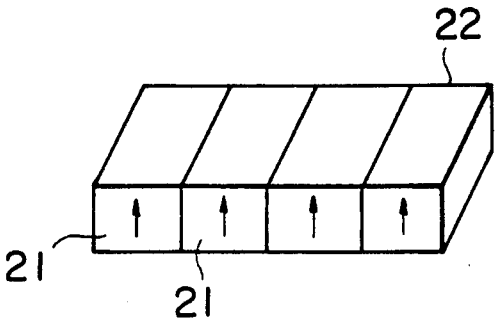

FIGS. 3 and 4 are perspective views illustrating the first embodiment of this invention. In FIG. 3, numeral 1 refers to a block, formed in such a manner as to be sintered into a size of 22.5 mm in width, 25 mm in height and 50 mm in length. Arrow A denotes the direction in which anisotropy is imparted, and arrow B the pressing direction during preliminary molding. FIG. 4 illustrates a molded product 22 obtained by forming four blocks 21 as shown in FIG. 3 that are arranged in the anisotropy imparting direction shown by arrow A into one piece by cold hydrostatic pressing, which will be described later. A method of manufacturing the block 21 and the molded product 22 will be described in the following.

First, a $SmCo_5$ permanent magnet alloy consisting of 38 wt. % of Sm and the balance of Co was prepared by arc melting and cast into ingots. The ingots obtained were roughly ground in a stamping mill down to minus 35-mesh, and then pulverized in a ball mill for three hours. Next, the powder obtained in this way was charged in a mold having a cavity of a 22.5 mm × 50 mm cross section, and subjected to preliminary molding by applying a vertical pressure of 0.7 t/cm$^2$ in a state where a parallel magnetic field of 8000 Oe was applied in the horizontal direction to form a block 21 as shown in FIG. 3. A hydraulic press with a lifting mechanism was used in the above-mentioned preliminary molding so as to prevent cracks and other defects from occurring in a 25 mm-high block 1 by lifting the upper punch 3/100 mm above during stripping after the block had been press molded. This was because the block 21 might be destroyed by the weight of the upper punch during stripping since the molding pressure exerted during the above-mentioned preliminary molding was considerably smaller than the normal molding pressure of 3.5–4.0 t/cm$^2$, and the density and strength of the resulting block 21 was insufficient. Next, four blocks 21 were arranged in the anisotropy imparting direction shown by arrow in FIG. 4, and sealed in a 0.1 mm-thick vinyl chloride bag. By removing the air in the bag, the four block 21 were formed into a 50 mm-wide, 35 mm-thick and 90 mm-long aggregate by bringing in close contact the adjoining sides of the four blocks 21 The aggregate of the blocks 21 sealed in the vinyl chloride bag was charged in a cold hydrostatice press to form a molded product 22 as shown in FIG. 4 by applying a 3-t/cm$^2$ pressure After the upper and lower surfaces of the molded product 22 were surface ground to remove metal by 0.8 mm, it was found that a perfectly integrated one-piece molded product was obtained, with no seams found between the adjoining blocks 21, though seams are indicated in FIG. 4 for the sake of clarity of explanation. This is attributable to the fact that the density of the block 21 obtained by preliminary molding is low and the surface roughness of the block 21 is relatively large, and therefore the fine particles in the adjoining blocks 21 and 21 are engaged with each other when subjected to cold hydrostatic pressure, resulting in a powder-metallurgically monolithic mass. The molded product 22 thus obtained was sintered at 1,150° C. for 1 hour in an argon atmosphere, allowed to stand at 950° C. for 1.5 hours in the same atmosphere, and subjected to heat treatment in which the molded product 22 was gradually cooled in an argon gas stream at 790° C. at a cooling rate of 1.3° C./min.

Figure 5:
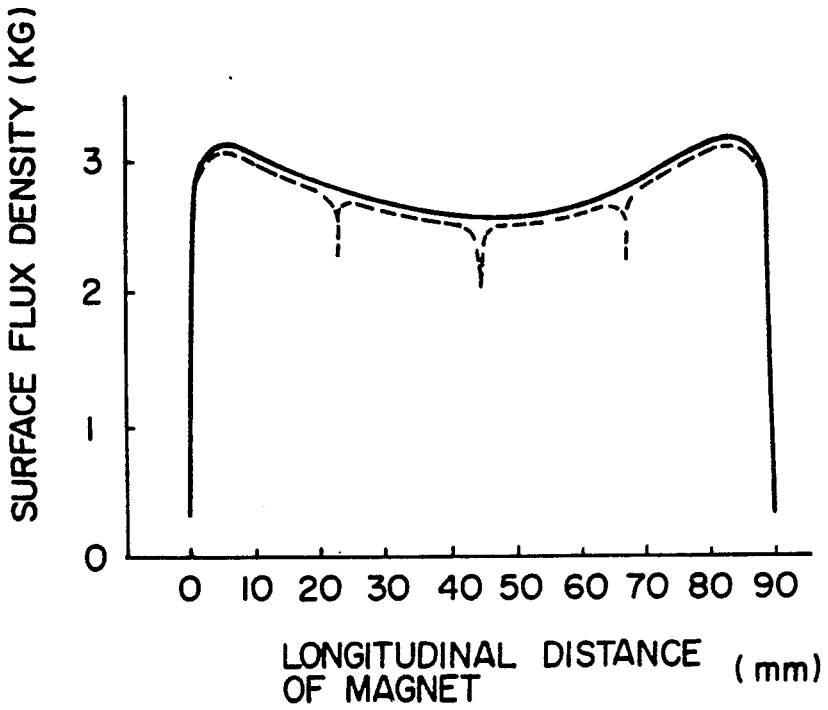
FIG. 5 is a diagram illustrating the relationship between the position in the longitudinal direction and the surface magnetic flux density of a permanent magnet.

FIG. 5 is a diagram illustrating the relationship between the position in the longitudinal direction and the surface magnetic flux density of a permanent magnet; a solid line and broken line in the figure indicating the relationship for the method of this invention and for the conventional method, respectively. The solid line represents the relationship of a permanent magnet by magnetizing the molded product prepared with the above-mentioned method, using a 25-kOe-pulse magnetic field. When the surface magnetic flux density on the N-pole side was measured with a Siemens FA-22E probe by keeping a 0.5 mm gap from the magnetized surface of the permanent magnet, values over 2,500G were observed over the entire surface, indicating no evidence of lowered surface magnetic flux density along the seams of the adjoining blocks 21 and 21 shown in FIG. 4. The broken line, on the other hand, represents the measurement results of the surface magnetic flux density of a permanent magnet obtained by magnetic-field forming the molded product shown in FIG. 3 by applying a pressure of 3.5 t/cm$^2$ using a hydraulic press in the conventional method, sintering and subjecting to heat treatment under the above-mentioned conditions, surface grinding, bonding together with epoxy resin, and magnetizing under the same conditions. As is evident from FIG. 5, the permanent magnet obtained by the conventional method has lowered surface magnetic flux density over the joint surface, while the permanent magnet obtained by the method of this invention has particularly excellent properties. The following values were obtained by measuring the magnetic properties of 9 mm-square×9.5 mm-long test pieces prepared from the permanent magnet produced with the method of this invention. By comparing these values with those of the magnets produced by the conventional lateral magnetic field press forming, it was confirmed that the magnetic properties of the permanent magnet produced by the method of this invention ar more than equal to those of the conventional permanent magnet.

| | |
|---|---|
| Br = 9090 G | $_BH_C$ = 8630 Oe |
| $_JH_C$ = 24200 Oe | $(BH)_{max}$ = 19.6 MGOe |

In FIG. 5, the permanent magnet produced by this invention exhibits a slightly higher surface magnetic flux density value than that produced by the conventional method. The following test was conducted to clarify the reason. Molded products of 12 mm×13 mm×11 mm in size were magnetic-field molded from $SmCo_5$ magnetic powders by changing molding pressure with a hydraulic press, and sintered and heat-treated under the same conditions as described above. After the resulting sintered products was surface-ground by 0.2 mm and then magnetized under the same conditions as described above, the surface magnetic flux density of the sintered products on the N-pole side was measured.

Figure 6:
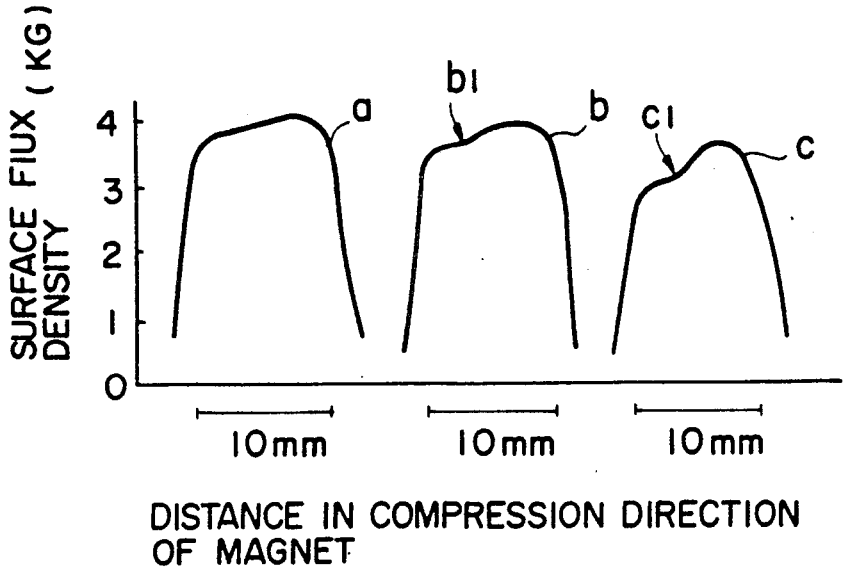
FIG. 6 (PRIOR ART)
FIG. 6 is a diagram illustrating the relationship between the position in the molding direction and the surface magnetic flux density of a permanent magnet.

FIG. 6 is a diagram illustrating the relationship between the position in the molding direction and the surface magnetic flux density of a permanent magnet produced by the above-mentioned conventional method. Curves a, b and c correspond to molding pressures of 3 t/cm$^2$, 4 t/cm$^2$ and 5 t/cm$^2$, respectively, with the left-side of each curve representing the lower-punch side. In FIG. 6, the surface magnetic flux density value generally declines as molding pressure is increased. That is, the curve b is, as a whole, lower in height than the curve a, and similarly the curve c is lower than the curve b, as indicated in the figure. In the curves b and c (involving high molding pressures), "knicks" were found generated, as indicated by arrows $b_1$ and $c_1$, and the surface magnetic flux density values on the left-side of the curves, or on the lower-punch side, were remarkably deteriorated. The decrease in surface magnetic flux density is attributable to the fact that the magnetic particles which has been oriented by the action of magnetic filed are forcibly subjected to plastic fluidization under increased molding pressures, and as a result the orientation of the magnetic particles is disturbed. In this invention, on the other hand, the magnetic particles which has been oriented in the magnetic field is less disturbed since the pressure of preliminary molding in a magnetic field of less than 1.0 t/cm$^2$ is relatively low. Even when a high pressure is applied in the succeeding high-pressure molding process, the orientation of magnetic particles is not disturbed because isostatic molding pressure is exerted by the hydrostatic press. The above results reveal that the permanent magnets produced by the method of this invention show high surface magnetic density values, as shown in FIG. 5, and are more advantageous in terms of magnetic properties compared with those produced by the conventional method. The fact that both ends of curves in FIGS. 5 and 6 show high values is attributable to the so-called edge effect that is caused by the spurting of magnetic flux from the edges of the permanent magnet.

Now, the second embodiment of this invention will be described in the following.

Figure 7:
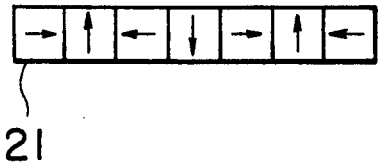
FIG. 7 is a diagram of assistance in explaining the second embodiment of this invention.

A plurality of blocks 21 shown in FIG. 3 were produced by the same method as with the first embodiment, and arranged in such a manner as shown in FIG. 7. Arrows in FIG. 7 denote the directions of anisotropy imparted to the blocks 21. The aggregate thus obtained was sealed and deaerated in a vinyl chloride bag, as in the case of the first embodiment, and molded into one molded product by means of a cold hydrostatic press. The resulting molded product was subjected to similar sintering, heat treatment and magnetizing processes to those used with the first embodiment to produce a permanent magnet used for the wigglers.

Figure 8:
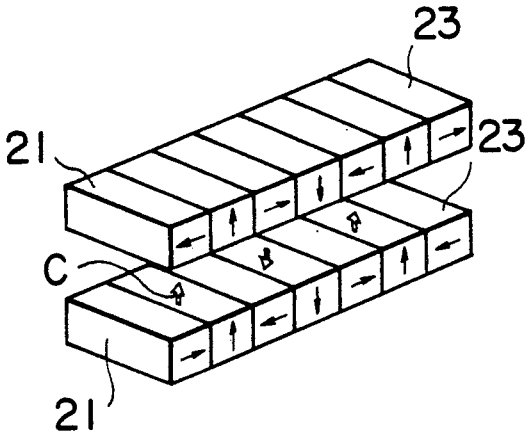
FIG. 8 is a perspective view of the essential part of a permanent magnet for a wiggler.

FIG. 8 is a perspective view of the essential part of a typical permanent magnet used for the wigglers. Although a plurality of blocks 21 are shown with seams between blocks for the sake of convenience, the blocks 21 are actually powder-metallurgically bonded together into on piece to such an extent that no seams exits between the blocks 21. In FIG. 8, an alternate magnetic field as shown by arrow C can be produced between the wiggler permanent magnets 23 and 23 by arranging the blocks into such anisotropic directions (directions of magnetic flux) as rightward, upward, leftward, downward, rightward—directions, for example. Thus, a cyclic magnetic field can be exerted on the electron beam (not shown) passing between the wiggler permanent magnets 23 and 23 in the direction normal to the travelling direction.

Figure 9:
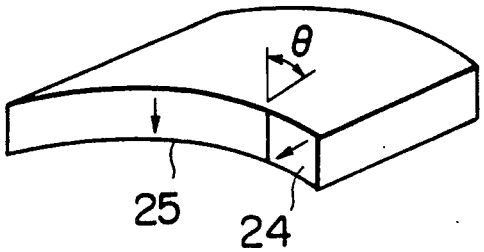
FIG. 9 is a perspective view illustrating the third embodiment of this invention.

FIG. 9 is a perspective view illustrating the third embodiment of this invention. In FIG. 9, numeral 24 refers to an end block, 25 to an intermediate block; the end block 24 and the intermediate block 25 being imparted anisotropy as shown by arrow with the side surfaces thereof being powder-metallurgically bonded together into one piece. In order to manufacture an anisotropic permanent magnet, it is effective to combine low-pressure preliminary molding and high-pressure cold hydrostatic pressing, as in the case of the first embodiment. That is, the end block 24 and the intermediate block 25 are formed by the magnetic-field preliminary molding, as in the case of the first embodiment, so that the anisotropic directions of the blocks have a difference of $\theta$, as shown in FIG. 9. Next, the end block 24 is brought into close contact with the end face of the intermediate block 25 to form an aggregate. The resulting aggregate is sealed in a vinyl chloride bag and deaerated, and subjected to cold hydrostatic pressing to form a one-piece arc-segment-shaped molded product. In order to ensure the shape of an arc segment, a jig having an arc-shaped outer periphery corresponding to the radius of curvature on the concave side thereof may be used. The one-piece molded product is then subjected to predetermined sintering and heat-treatment processes to form an arc-segment permanent magnet. Since the arc-segment permanent magnet thus formed has large residual magnetic flux density at the central part thereof and large coercive force at the ends thereof, the magnet, when used as the motor stator, can have a large resistance to the demagnetization exerted on the ends of the stator by the armature.

In the above embodiment, description has been made on $SmCo_5$ anisotropic rare-earth permanent magnets. This invention, however, can be applied not only to $Sm_2Co_{17}$ permanent magnets but also to recently developed Nd-Fe-B permanent magnets. To use in environment where the aforementioned radiation exists, Sm-Co permanent magnets are most suitable since Sm-Co permanent magnets involve less risks of deteriorated magnetic flux due to radiation, have a high Curie-temperature and a low irreversible demagnetizing factor even when heated at 120° C. and allowed to cool after magnetization to stabilize the amount of magnetic flux, and is favorable in terms of permeance coefficient due to its high coercive force. The permeance coefficient p used here can be calculated from the ratio Bd/Hd of magnetic flux Bd and coercive force Hd at a given operation point on the demagnetization curve representing the properties of an anisotropic permanent magnet, and is expressed by $p=Bd/\mu_0 Hd$ ($\mu_0$:magnetism constant (space permeability)).

The dimensions and shape of blocks and molded products to be formed by preliminary molding and cold hydrostatic pressing can be freely selected taking into consideration the properties and applications, etc. required for anisotropic rare-earth permanent magnets.

In this invention, the molding pressure required for preliminary molding, in which the powder of permanent magnet material is molded in a metal mold disposed in a magnetic field must be more than 0.6 t/cm$^2$ because molded products could not maintain a strength enough to withstand handling in the subsequent processes if molded at molding pressures less than 0.6 t/cm$^2$. At molding pressures exceeding 1.0 t/cm$^2$, on the other hand, it would be difficult to powder-metallurgically bind into one piece the aggregate of multiple anisotropic blocks obtained in preliminary molding, using a commonly used hydrostatic press having the maximum hydrostatic molding pressure of about 4 t/cm$^2$. The molding pressure of 1.0 t/cm$^2$ mentioned above must not be regarded as a limitation to this invention because molding pressure can be improved in the future as the capacity of the hydrostatic press is improved. The current problem is therefore just the difficulty of obtaining commercial-scale hydrostatic presses.

Application of magnetic field during preliminary molding may be in the same direction as (or in the direction parallel to) the compression molding direction or the pressing direction. (This is usually called the longitudinal magnetic-field pressing.) In order to manufacture large permanent magnets having excellent magnetic properties, however, it is desirable that application of magnetic field should be in the direction normal to the direction of compression molding or the pressing direction. (This is called the lateral magnetic-field pressing.) This is because, in the longitudinal magnetic-field pressing, the magnetic particles oriented in the same direction as the axis of easy magnetization by the magnetic field are disturbed in orientation by the pressing pressure. Needless to say, the manufacturing method of this invention involving hydrostatic pressing after preliminary molding may be applied not only to a plurality of blocks but also to a single block.

As the material of a bag in which an aggregate of a plurality of blocks in a sealed state should preferably be rubber, synthetic resin or any other material that is flexible, and inert and impermeable to water used as a hydrostatic pressure medium, low-viscosity oil, glycerin, etc. After an aggregate of a plurality of blocks is sealed in a bag having impermeability, the air in the bag is removed to cause the bag to come in close contact with the outer surface of the aggregate. This ensures a powder-metallurgical bond of the blocks during the subsequent cold hydrostatic pressing process, and is desirable to retain the dimensions and shape of the aggregate during the handling of the aggregate during hydrostatic pressing process.

Figure 10:
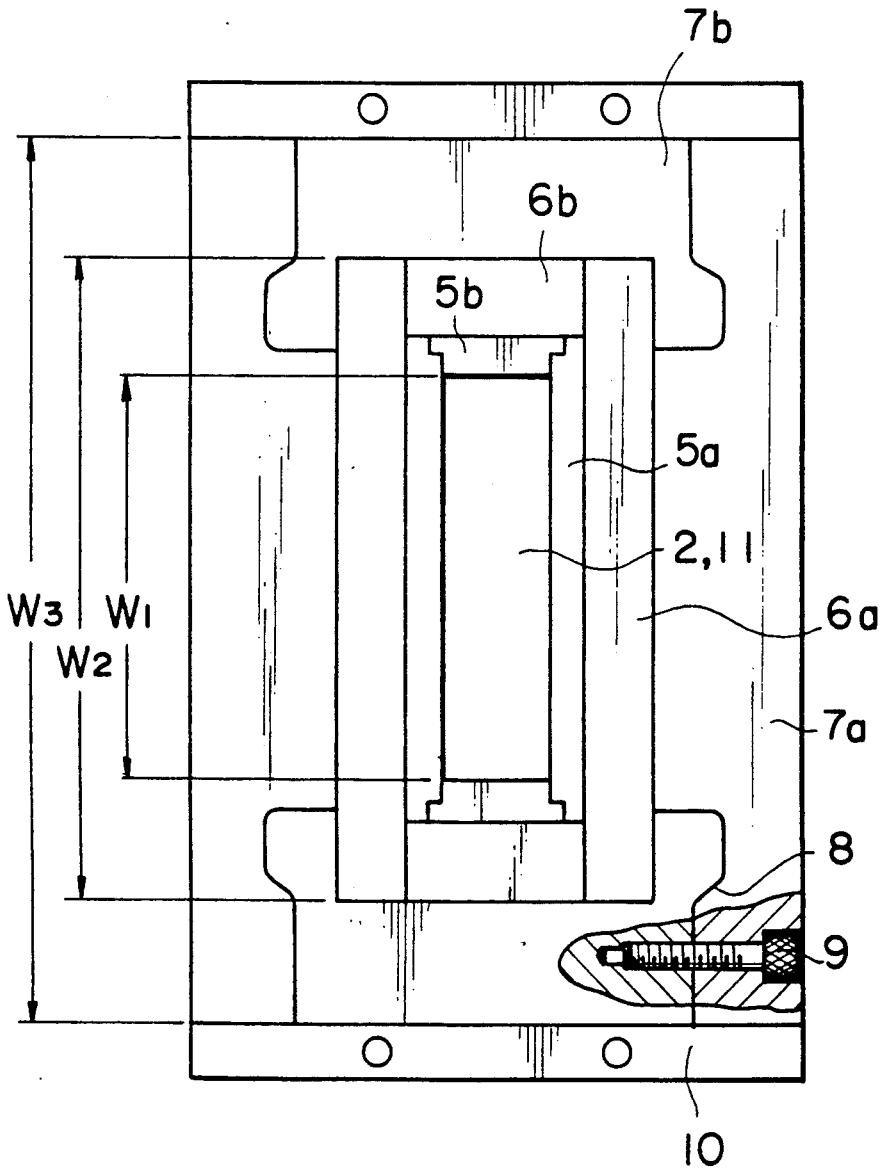
FIGS. 10 through 12 are a plan view, partially sectional front view and partially sectional side view, respectively of the essential part of a metal mold used in the fourth embodiment of this invention.
Figure 11:
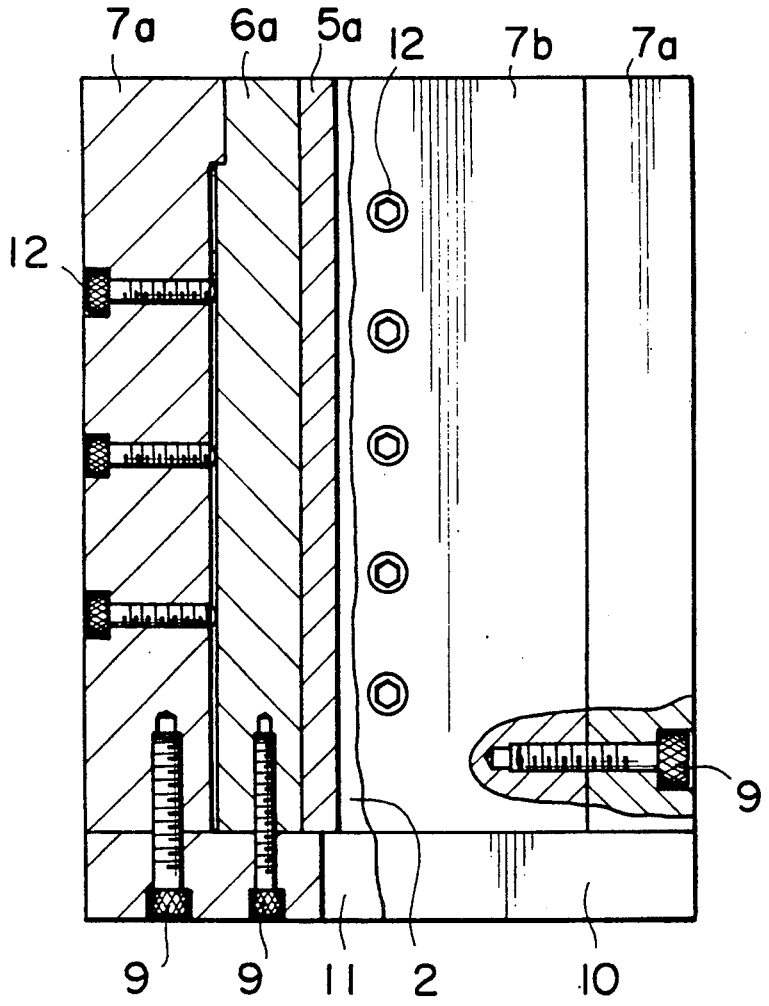
Figure 12:
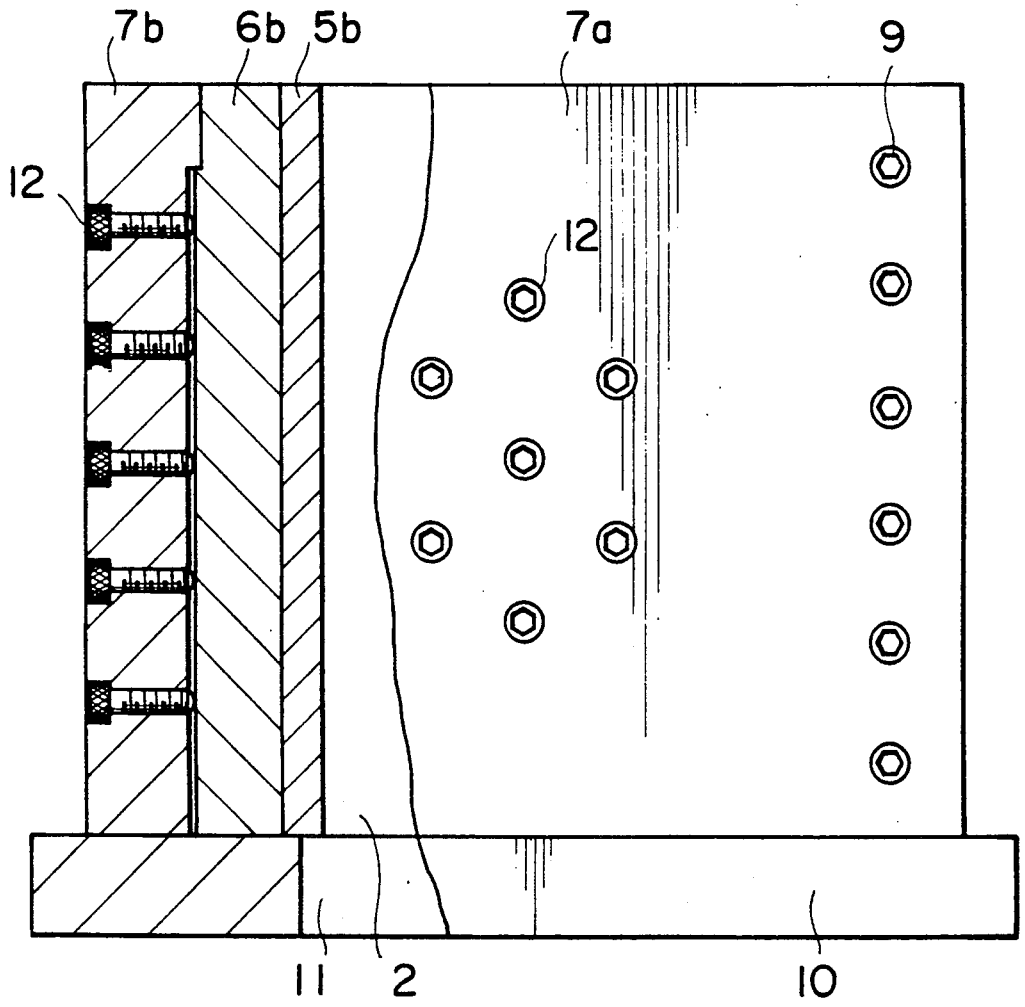

FIGS. 10 through 12 are a plan view, a partially sectional front view and a partially sectional side view of the essential part of a metal mold in the fourth embodiment of this invention. In these FIGS., 5*a* and 5*b* refer to die pieces, made of a hard wear-resistant material, such as a cemented carbide alloy. These die pieces 5*a* and 5*b* are formed into a sheet having an inverted T shape in cross section, with the adjoining shouldered parts being assembled to form a molding cavity 2 having a rectangular cross section. Next, 6*a* and 6*b* refer to side plates; 7*a* and 7*b* to holders; each disposed in that order outside the die pieces 5*a* and 5*b*. The side plate 6*a* and the holder 7*a* are made of a magnetic material, such as tool steel, and the side plate 6*b* and the holder 7*b* are made of a non-magnetic material, such as stainless steel. By providing a dado and rabbet joint 8 at the joint portion of the holders 7*a* and 7*b*. the die pieces 5*a* and 5*b* and the side plates 6*a* and 6*b* can be securely fastened in place when the holders 7*a* and 7*b* are fastened by means of a bolt 9. Numeral 10 refers to a base plate which is fixedly fitted to the lower part of the die pieces 5*a* and 5*b*, the side plates 6*a* and 6*b*. That is, the side plates 6*a* and 6*b* and the holders 7*a* and 7*b* are fixedly fitted to the base plate 10 by means of a bolt 9. A hole 11 having an outside contour slightly larger than the outer contour of the molding cavity 2 is drilled almost at the center of the base plate 10. Numeral 12 refers to a pushing bolt; a plurality of the pushing bolts 12 being installed almost in the middle of the holders 7*a* and 7*b* in such a manner that the tips of the bolts 12 are caused to make contact with the outer periphery of the side plates 6*a* and 6*b*. The side plate 6*a* and the holder 7*a* are formed in such a manner that the widths $W_2$ and $W_3$ of the side plate 6*a* and the holder 7*a* satisfy the equation $W_1<W_2<W_3$ with respect to the width $W_1$ of the molding cavity 2 on the side corresponding to the side plate 6*a* and the holder 7*a*.

Now the correlationship between the widths $W_1$ and $W_2$ will be described. In order to keep the deflection angle, or the inclination angle, of magnetic flux with respect to the direction of magnetization within three degrees even at an end of the molding cavity 2 (on the side of the die piece 5*b*). $W_1/W_2$ should preferably be equal to. or less than 0.95 ($W_1/W_2 \leqq 0.95$). Furthermore, in order to keep the deflection angle, or the inclination angle, within two degrees, $W_1/W_2$ must be equal to, or less than 0.9 ($W_1/W_2 \leqq 0.9$). When $W_1/W_2 \leqq 0.8$, the deflection angle, or the inclination angle, can be kept within 0.5 degrees.

With the above construction, when lateral magnetic field generating members (not shown) each consisting of a permanent magnet or electromagnet are disposed outside of the holder 7*a* and a magnetic field is applied, a parallel magnetic field having no deflection is generated within the molding cavity 2. This is because magnetic flux is concentrated to the molding cavity 2 since the side plate 6*a* and the holder 7*a* on the side facing the lateral magnetic field generating members are made of a magnetic material, and the widths $W_2$ and $W_3$ thereof are made larger than the width $W_1$ of the molding cavity 2 so as to satisfy the equation $W_1 < W_2 < W_3$. Consequently, anisotropic permanent magnets having excellent magnetic properties can be molded by slidably fitting upper and lower punches (not shown) to both ends of the molding cavity 2, and compression molding the raw material powder charged in the molding cavity. During compression molding, an internal pressure generated by the raw material powder compressed by the upper and lower punches tends to be exerted in the molding cavity 2, causing the metal mold component members to warp outwardly and deform. A plurality of bolts 12 provided almost in the middle of the holders 7*a* and 7*b* formed into a relatively large wall thickness push the side plates 6*a* and 6*b*, preventing the die pieces 5*a* and 5*b* and the side plates 6*a* and 6*b* from being bulged outward and deformed. Thus, the inside dimensions of the molding cavity 2 can be accurately maintained, and the dimensional accuracy of permanent magnets being formed can be maintained at a high level. When Sm-Co anisotropic rare-earth magnets and Nd-Fe-B anisotropic rare-earth magnets of a size of 36 mm×152 mm×130 mm were formed by using a molding cavity 2 formed into a size of 36 mm×152 mm×270 mm (height), it was confirmed that the magnetic properties, particularly orientation properties of the permanent magnets formed were quite excellent. Even after the continuous molding of such large permanent magnets, no cracks, deformation, etc. were found on the metal mold component members.

The hydraulic press used in the molding process described above is a Model YUPOC-100 100-ton four-column type hydraulic press, manufactured by Yuken Kogyo Co., Ltd., which has an upper cylinder pressure capacity of 10–100 tons, and a lower cylinder floating capacity of 2–18.5 tons. By installing the above-mentioned metal mold on this hydraulic press, molded products of the above-mentioned dimensions were obtained in a parallel magnetic field of 10,000 Oe under the following conditions.

Molding pressure: 44 tons
Floating Pressure: 20 tons
Pressure retention time: 2 sec.
Pressure relief time: 4 sec.
Floating pressure relief time: 4 sec.
Temporary stop before pressure application: 1 sec.
Depth of molding cavity: 265 mm
Amount of powder charge:
  Sm-Co powder—3.3 kg
  Nd-Fe-B powder—2.8 kg
Degree of opening for determining the amount of lifting oil: 20%
Lifting time: 2.2–2.6 sec.

In this embodiment, description has been made on the molding cavity of a rectangular cross section. However, the same effects can be achieved with the molding cavity of other geometric shapes. The material of the die piece may be other hard wear-resistant materials than cemented carbide alloys. Furthermore, the die pieces on the side facing the lateral magnetic field generating member may be a magnetic material, like the side plates and the holders. Anisotropic permanent magnets may be other rare-earth magnets than the Sm-Co system, or other materials than rare-earth magnets.

This invention having the aforementioned construction and operation can achieve the following effects.

(1) One-piece and large-size permanent magnets can be obtained without bonding a plurality of small-size blocks of permanent magnets using dissimilar materials such as adhesive.
(2) Even permanent magnets having locally different anisotropic directions can be relatively easily manufactured, let alone those having anisotropy in the longitudinal direction.
(3) Since a plurality of blocks molded by low-pressure preliminary molding are powder-metallurgically bonded together into one piece by cold hydrostatic pressing, permanent magnets that are extremely consistent in terms of material and magnetic properties can be relatively easily manufactured.
(4) Large-size anisotropic permanent magnets having excellent magnetic properties can be molded since a parallel magnetic field can be generated even in a large-size molding cavity without deflecting magnetic flux.
(5) High-precision molding is possible because the die pieces defining the molding cavity are supported under pressure by the screw members and the side plates inserted in the holder.
(6) The metal mold can be manufactured relatively easily. As the rigidity of the metal mold can be improved, the life of the mold can be extended without causing cracks and deformation.

What is claimed is:

1. A metal mold for molding anisotropic permanent magnets, said mold being disposed between a pair of laterally opposed magnetic field generating members, with upper and lower punches slidably fitted to both ends of a molding cavity defined within said mold, said mold comprising a die constituting said molding cavity constructed of a plurality of die pieces; first side plates being disposed on opposite sides of the molding cavity adjacent said die pieces; first holders being disposed on opposite sides of the molding cavity adjacent said first side plates, said first side plates and said first holders face the lateral magnetic field generating members and are made of a magnetic material; the respective widths $W_1$, $W_2$, and $W_3$ of said molding cavity, said side plates and said holder in a direction orthoginal to the lateral magnetic field generating members are formed so as to satisfy the equation $W_1 < W_2 < W_3$; second side plates disposed on opposite sides of said molding cavity adjacent to said die pieces and orthogonal to said lateral magnetic field generating members; and second holders disposed on opposite sides of said molding cavity adjacent said second side plates; said second side plates and said second holders are made of a nonmagnetic material; said side plates are forced against said die pieces by a plurality of screw members inserted into said holders.

2. A metal mold for molding anisotropic permanent magnets as set forth in claim 1 wherein said die pieces are made of a cemented carbide alloy.

3. A metal mold for molding anisotropic permanent magnets as set forth in claim 1 or 2 wherein said die pieces on the sides of the mold cavity facing said lateral magnetic field generating members are made of a magnetic material.

* * * * *